US006044733A

United States Patent [19]

Liu

[11] Patent Number: 6,044,733

[45] Date of Patent: Apr. 4, 2000

[54] SCREWDRIVER HAVING A RETRACTABLE AND FLEXIBLE SHANK

[75] Inventor: Chang-Chang Liu, Chungho, Taiwan

[73] Assignee: Yung-Hsing Chiu, Taichung Hsien, Taiwan

[21] Appl. No.: 09/196,659

[22] Filed: Nov. 19, 1998

[51] Int. Cl.[7] ..... B25B 23/16

[52] U.S. Cl. ..... 81/177.6; 81/177.2

[58] Field of Search ..... 81/177.1, 177.8, 81/177.2, 177.6, 437, 438, 439

[56] References Cited

U.S. PATENT DOCUMENTS

| | | | |
|---|---|---|---|
| 2,796,101 | 6/1957 | Hasemann et al. | 81/177.6 |
| 2,963,930 | 12/1960 | Clothier et al. | 81/177.2 |
| 4,102,375 | 7/1978 | Rossini | 81/177.2 |
| 5,732,606 | 3/1998 | Chiang | 81/177.6 |

*Primary Examiner*—David A. Scherbel
*Assistant Examiner*—Joni B. Danganan
*Attorney, Agent, or Firm*—Kolisch Hartwell Dickinson McCormack & Heuser

[57] ABSTRACT

A screwdriver includes a handle and a shank retractably received in the handle, the shank having a flexible section and a bit removably attached to the distal end thereof. A tube securely extends from the handle and a second spring is mounted to the tube with a ball movably received in a passage radially defined through the tube. The shank has two annular grooves respectively defined on the outside thereof. A sleeve is movably mounted on the tube and has a recess defined in the inside thereof. The shank can be extended from the handle by pulling the sleeve toward the handle to release the ball from one of the two annular grooves and drop in the recess of the sleeve.

4 Claims, 4 Drawing Sheets

SCREWDRIVER HAVING A RETRACTABLE AND FLEXIBLE SHANK

FIELD OF THE INVENTION

The present invention relates to a screwdriver, and more particularly, to an improved screwdriver having a flexible shank retractably received in the handle thereof, and the shank has an engaging hole for receiving a bit therein.

BACKGROUND OF THE INVENTION

Conventional screwdrivers generally include a handle and a shank which extends from the handle and is a solid and metallic member which is not flexible. However, in some situations, the bolt or the nut is located in a narrow area where the conventional screwdriver cannot reach. In order to overcome this inconvenience, a connector having a universal joint was developed so that the socket or the bit could be connected to change its direction to facilitate tightening or loosening the bolt or the nut. Such a connector is an independent part which is stored in a tool box and cannot perform any function if no other tools are connected thereto. Therefore, the users have to carry the tool box with them in order to access a bolt, nut or screw in a narrow area.

The present invention intends to provide a screwdriver whose shank has a flexible section so as to change the direction of the bit or the socket attached to the shank.

SUMMARY OF THE INVENTION

In accordance with one aspect of the present invention, there is provided a screwdriver comprising a handle having a longitudinal space defined therein and a polygonal opening defined through one of two ends of the handle and communicating with the longitudinal space. A first spring is received in the longitudinal space. A tube has an operational section and a polygonal section which is securely engaged with the polygonal opening. A first shoulder portion and a second shoulder portion respectively extend radially outward from the operational section. A passage is defined radially through the operational section and a groove is defined in the outside of the operational section. A ball is movably received in the passage.

The shank has a first section and a second section with a flexible section connected therebetween. The first section securely extends through the tube and is connected to the first spring. The first section has a first annular groove defined in the outside thereof, and the second section has a second annular groove defined in the outside thereof. The second section has an engaging hole defined in the distal end thereof for receiving a bit therein. A second spring is mounted to the operational section and contacts the first shoulder portion.

A sleeve is slidably mounted to the operational section of the tube and has a first flange and a second flange respectively extending radially inward from the inside thereof so that a recess is defined between the first flange and the second flange. The second spring is received between the first flange and the first shoulder portion. A clamp is received in the groove of the operational section to prevent the second flange from sliding over the operational section. A ball is received in the recess when the sleeve is pulled toward the handle such that the shank can be moved.

The object of the present invention is to provide a screwdriver which has a retractable shank having a flexible section so as to access a nut, bolt or screw located in a place where general screwdrivers cannot reach.

Further objects, advantages, and features of the present invention will become apparent from the following detailed description with appropriate reference to the accompanying drawings.

DETAILED DESCRIPTION OF THE PREFERRED EMBODIMENTS

Figure 1:
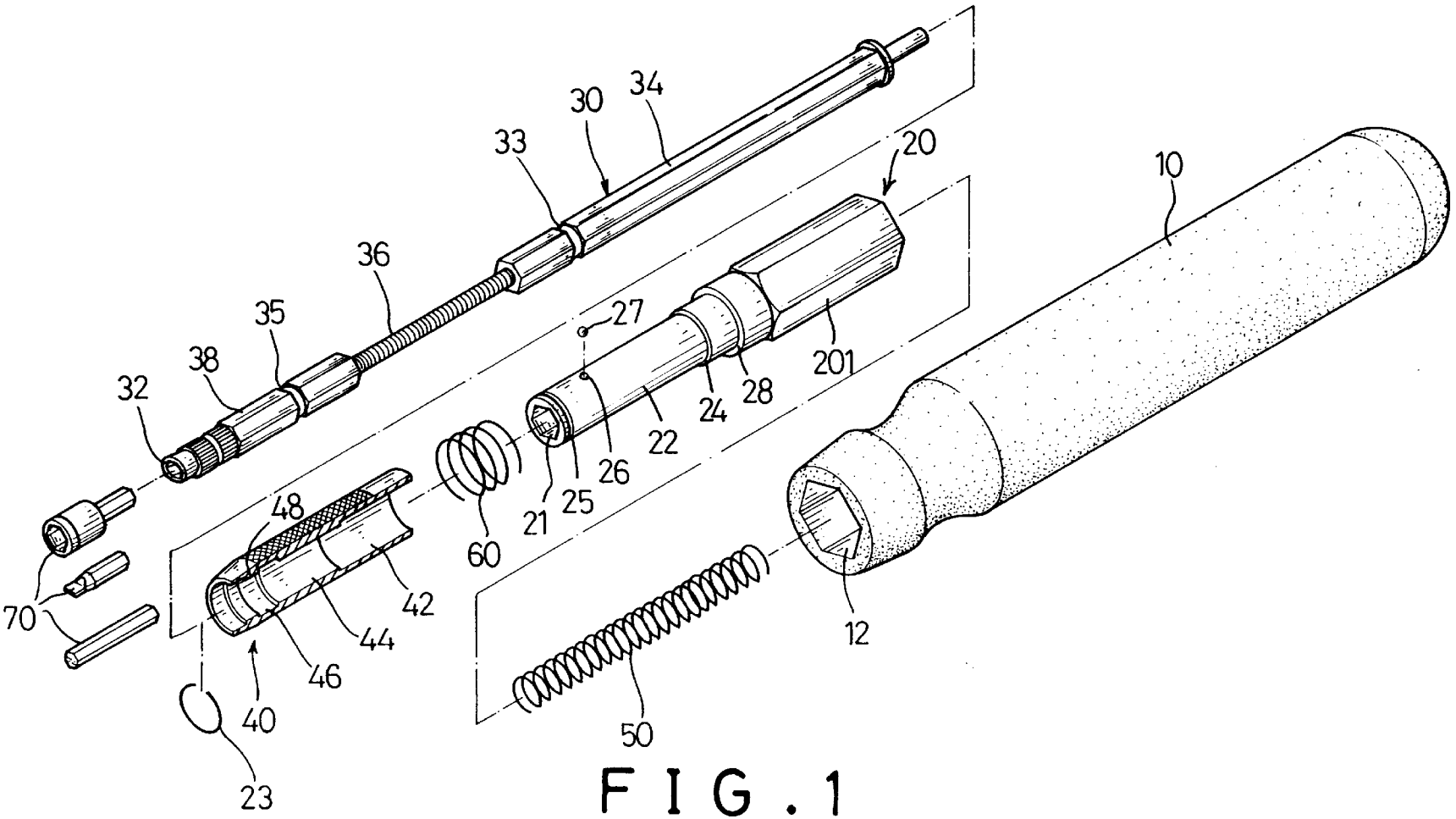
FIG. 1 is an exploded perspective view of the screwdriver in accordance with the present invention.
Figure 2:
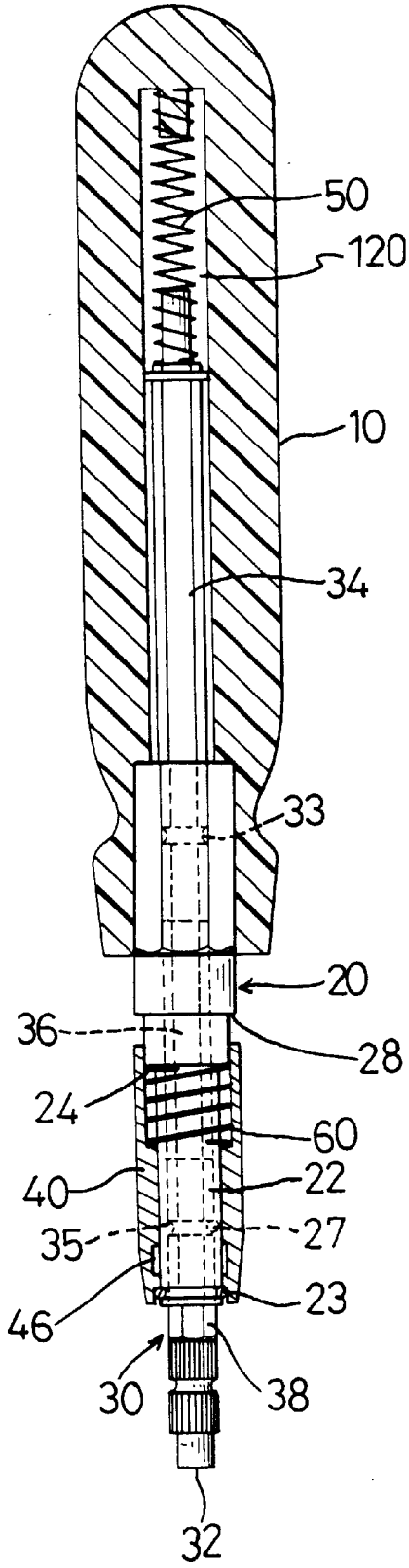
FIG. 2 is a side plan view, partly in section, of the screwdriver in accordance with the present invention, wherein the sleeve is not yet pulled.

Referring to FIGS. 1 and 2, the screwdriver in accordance with the present invention comprises a handle (10) having a longitudinal space (120) defined therein and a polygonal opening (12) defined through one of two ends of the handle (10) and the polygonal opening (12) communicating with the longitudinal space (120). A first spring (50) is received in the longitudinal space (120).

A tube (20) has a cylindrical operational section (22) and a polygonal section (201) which is securely engaged with the polygonal opening (12) so that the tube (20) is rotated with the handle (10). The tube (20) has a polygonal passage (21) defined centrally therethrough. A first shoulder portion (24) and a second shoulder portion (28) respectively extend radially outward from the operational section (22). A passage (26) is defined radially through the operational section (22) for receiving a ball (27) therein and a groove (25) is defined in the outside of the operational section (22).

A shank (30) has a first section (34) and a second section (38) with a flexible section (36) connected therebetween. The first section (34) securely extends through the tube (20) and is connected to the first spring (50) so that the first spring (50) can be pressed by pushing the shank (30) toward the handle (10). It is to be noted that the first section (34) and the second section (38) are shaped to be securely and movably received in the polygonal passage (21). The first section (34) has a first annular groove (33) defined on the outside thereof and the second section (38) has a second annular groove (35) defined on the outside thereof. The first annular groove (33) and the second annular groove (35) are sized to partially receive the ball (27) when the shank (30) is pulled relative to the sleeve (40). The second section (38) has an engaging hole (32) defined in the distal end thereof so as to receive a bit (70) therein. A second spring (60) is mounted on the operational section (22) and contacts the first shoulder portion (24).

Figure 3:
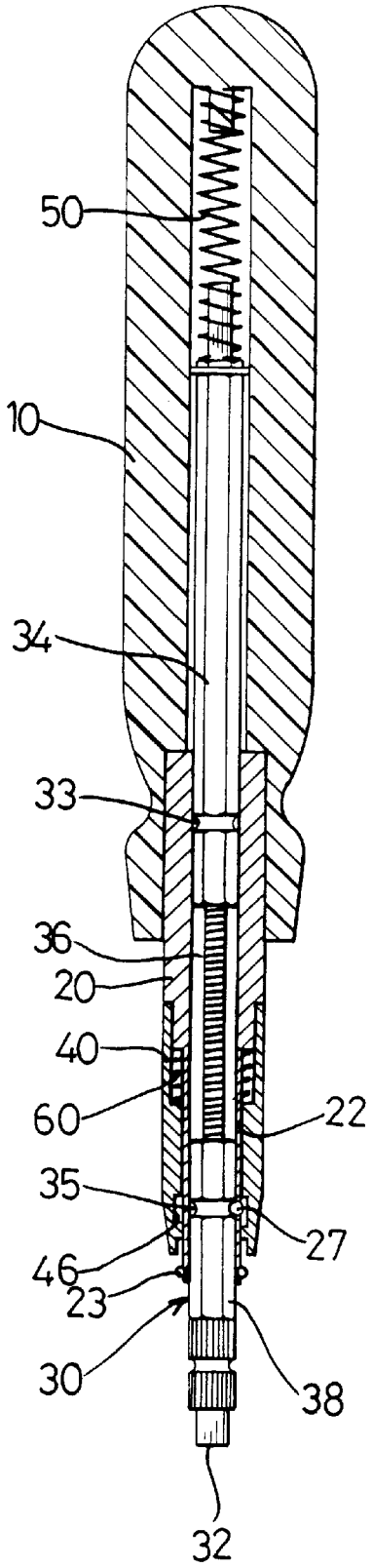
FIG. 3 is a side plan view, partly in section, of the screwdriver in accordance with the present invention, wherein the sleeve is pulled toward the handle.

The sleeve (40) is slidably mounted on the operational section (22) of the tube (20) and has a first flange (44) and a second flange (48) respectively extending radially inward from the inside thereof so that an annular recess (46) is defined between the first flange (44) and the second flange (48). The second spring (60) is received between the first flange (44) and the first shoulder portion (24) so that the sleeve (40) can be pulled toward the handle (10) by compressing the second spring (60) as shown in FIG. 3. With the sleeve (40) mounted on the operational section (22) and the operational section (22) extending out of the end of the sleeve (40), a C-ring (23) is installed in the groove (25) of the operational section (22) to prevent the second flange (48) from sliding off of the operational section (22). When the sleeve (40) is in its normal position as shown in FIG. 2, the ball (27) is pressed by the inside of the first flange (44) and partially received in either the first annular groove (33) or the second annular groove (35).

Figure 4:
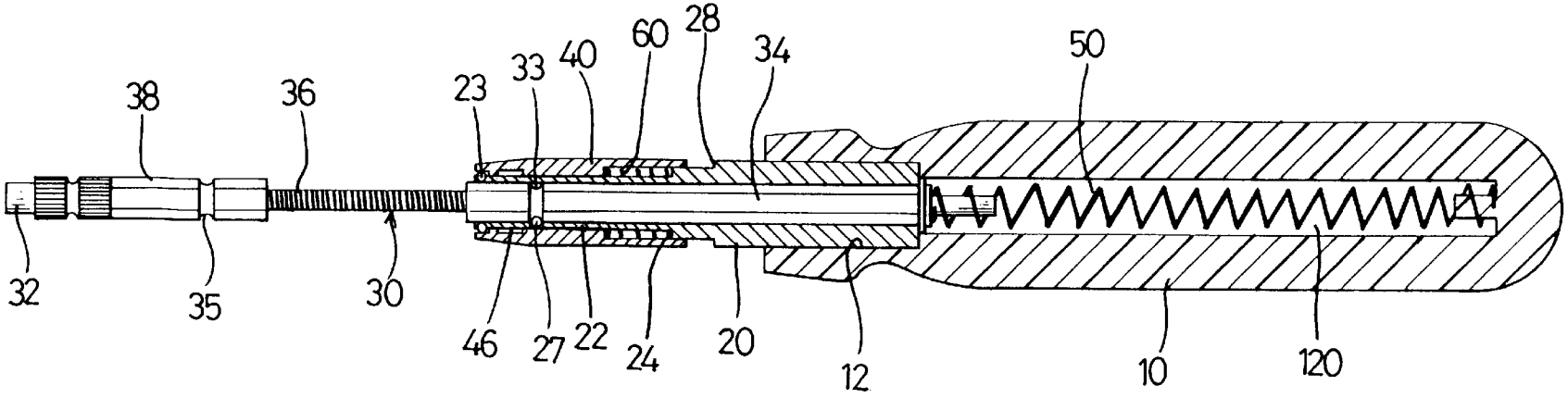
FIG. 4 is a side plan view, partly in section, of the screwdriver in accordance with the present invention, wherein the shank is extended from the sleeve.

Referring to FIGS. 3 and 4, when the sleeve (40) is pulled toward the handle (10), the recess (46) is moved to receive the ball (27) so that the ball (27) is released from the second annular groove (35) and the shank (30) can be moved relative to the sleeve (40). The shank (30) can be pulled till the ball (27) is partially received in the first annular groove (33) and the sleeve (40) is released so that the sleeve (40) returns to its initial position as shown in FIG. 2 by the return force of the second spring (60). The recess (46) is therefore shifted away from the ball (27) which is pressed again by the inside of the first flange (44).

As shown in FIG. 4, the flexible section (36) extends beyond the sleeve (40) so that the bit (70) is allowed to reach a bolt, nut or screw by bending the flexible section (36) where a normal screwdriver having a solid shank cannot reach. When the sleeve (40) is pulled toward the handle (10), the shank (30) will automatically jump from the sleeve (40) by virtue of the force of the first spring (50).

Although the invention has been explained in relation to its preferred embodiment, it is to be understood that many other possible modifications and variations can be made without departing from the spirit and scope of the invention as hereinafter claimed.

What is claimed is:

1. A screwdriver comprising:

a handle (10) having a longitudinal space (120) defined therein and a polygonal opening (12) defined through one of two ends of said handle (10) and communicating with said longitudinal space (120);

a first spring (50) received in said longitudinal space (120);

a tube (20) having an operational section (22) and a polygonal section (201) which is securely engaged with said polygonal opening (12), a first shoulder portion (24) and a second shoulder portion (28) respectively extending radially outward from said operational section (22), a passage (26) defined radially through said operational section (22), a groove (25) defined in the outside of said operational section (22) and a ball (27) movably received in said passage (26);

a shank (30) having a first section (34) and a second section (38) with a flexible section (36) connected therebetween, said first section (34) securely extending through said tube (20) and connected to said first spring (50), said first section (34) having a first annular groove (33) defined in the outside thereof and said second section (38) having a second annular groove (35) defined in the outside thereof, said second section (38) having an engaging hole (32) defined in the distal end thereof so as to be adapted to receive a bit therein, and a second spring (60) mounted to said operational section (22) and contacting said first shoulder portion (24), and a sleeve (40) slidably mounted to said operational section (22) of said tube (20) and having a first flange (44) and a second flange (48) respectively extending radially inward from the inside thereof so that a recess (46) is defined between said first flange (44) and said second flange (48), said second spring (60) received between said first flange (44) and said first shoulder portion (24), a clamp (23) received in said groove (25) of said operational section (22) to prevent said second flange (48) from sliding over said operational section (22), said ball (27) received in said recess (46) when said sleeve (40) is pulled toward said handle (10).

2. The screwdriver as claimed in claim 1, wherein said ball (27) is pressed by the inside of said first flange (44) when said sleeve (40) is not subjected to any longitudinal force.

3. The screwdriver as claimed in claim 1, wherein said first annular groove (33) and said second annular groove (35) are sized to partially receive said ball (27).

4. The screwdriver as claimed in claim 1, wherein said tube (20) has a polygonal passage (21) defined centrally therethrough, said first section (34) and said second section (38) being shaped to be securely and movably received in said polygonal passage (21).

* * * * *